US009700124B2

(12) United States Patent
Coleman

(10) Patent No.: US 9,700,124 B2
(45) Date of Patent: Jul. 11, 2017

(54) ARTICLE CARRIER

(71) Applicant: Robert Matthew Coleman, Townsend, DE (US)

(72) Inventor: Robert Matthew Coleman, Townsend, DE (US)

( * ) Notice: Subject to any disclaimer, the term of this patent is extended or adjusted under 35 U.S.C. 154(b) by 130 days.

(21) Appl. No.: 14/463,492

(22) Filed: Aug. 19, 2014

(65) Prior Publication Data

US 2015/0076182 A1 Mar. 19, 2015

Related U.S. Application Data

(60) Provisional application No. 61/867,435, filed on Aug. 19, 2013.

(51) Int. Cl.
*A45F 4/02* (2006.01)
*A45F 3/04* (2006.01)

(52) U.S. Cl.
CPC ..... *A45F 4/02* (2013.01); *A45F 3/04* (2013.01); *A45F 2004/026* (2013.01)

(58) Field of Classification Search
CPC ..... A45F 4/02; A45F 3/04; A45F 2004/026; A47C 4/52
See application file for complete search history.

(56) References Cited

U.S. PATENT DOCUMENTS 5,927,575 A * 7/1999 Gatling ..... A01M 31/02 224/153

* cited by examiner

*Primary Examiner* — Corey Skurdal
(74) *Attorney, Agent, or Firm* — John Gillick

(57) ABSTRACT

An article carrier is an apparatus designed to transport, protect, and organize a user's equipment and personal items, particularly when spending time outdoors. The article carrier features a backpack as well as a deployable cushioned/padded seat that allows the article carrier to be utilized with existing outdoor equipment such as a tree stand. The article carrier may be mounted to a structure or object such as a tree. The backpack provides a cushioned/padded backrest as well when utilizing the seat. The article carrier features a left wing and a right wing that provide further storage capacity and organization for the user's equipment and personal items. The left wing and right wing may be repositioned and are detachable from the article carrier and may comprise varying numbers and types of storage compartments. The article carrier may be utilized in a compact configuration for compactness or alternatively, in a deployed configuration.

17 Claims, 5 Drawing Sheets

ARTICLE CARRIER

The current application claims a priority to the U.S. Provisional Patent application Ser. No. 61/867,435 filed on Aug. 19, 2013.

FIELD OF THE INVENTION

The present invention relates generally to a load carrying system and organizer. More specifically, the present invention is an article carrier that serves as a modular equipment carrier and organizer system. The article carrier features a deployable, cushioned/padded seat with backrest as well for use with devices such as tree stands or any chair type seating.

BACKGROUND OF THE INVENTION

When spending extended periods of time outdoors such as when hunting, fishing, or camping, the need often arises to carry a large amount of equipment and personal items. A backpack is capable of balancing and comfortably distributing weight and as such is generally the preferred means of transporting a large number of items that one may need during time spent outdoors. While backpacks serve the utilitarian role of housing, transporting, and protecting large amounts of equipment and personal items, organization within the backpacks is often an issue. Backpacks are available in numerous variants that are designed to address the individual needs of users. The vast majority of backpack designs include one or two primary compartments for storing large items as well as additional smaller compartments and pockets for storing smaller items. These smaller compartments and pockets may be located on the interior or exterior of the backpacks and are designed for holding small items that the user may quickly access. A disorganized backpack can be a severe annoyance, particularly if the user must quickly locate and use a particular item. If a backpack is used to carry a diverse array of equipment, it can often be difficult to locate a specific item that is needed, leaving the user to rummage and fumble through the various compartments and pockets of the backpack.

The present invention is an article carrier for transporting, protecting, and organizing equipment and personal items, particularly when outdoors. The article carrier may be worn in the same manner as a conventional backpack. Additionally, the article carrier may be mounted to a structure or object such as a tree and utilized in conjunction with existing outdoor equipment such as a tree stand or any chair type seating. In this configuration, the article carrier may be utilized as a cushioned/padded seating device.

DETAIL DESCRIPTIONS OF THE INVENTION

All illustrations of the drawings are for the purpose of describing selected versions of the present invention and are not intended to limit the scope of the present invention.

The present invention is an article carrier for transporting, protecting, and organizing equipment and personal items during time spent outdoors. The present invention is shown in a compact configuration in FIG. 1 and FIG. 2 and unfolded in FIG. 3 and FIG. 4. The article carrier comprises a backpack 1, a seat 14, a left wing 16, and a right wing 17. The backpack 1 is utilized to store and organize equipment and may be secured to a structure or object such as a tree or any chair type seating. Once the backpack 1 is mounted and secured, the seat 14 may be deployed to provide a cushioned/padded seating surface when the article carrier is utilized in conjunction with existing outdoor equipment such as a tree stand or any chair type seating. The left wing 16 and the right wing 17 provide further storage capacity and organization for equipment and personal items and may be mounted to the seat 14 utilizing a modular mounting system. As the article carrier is primarily intended for outdoor use, in the preferred embodiment of the present invention, the backpack 1, the seat 14, the left wing 16, and the right wing 17 are composed of a flexible, durable, and weatherproof material.

Figure 1:
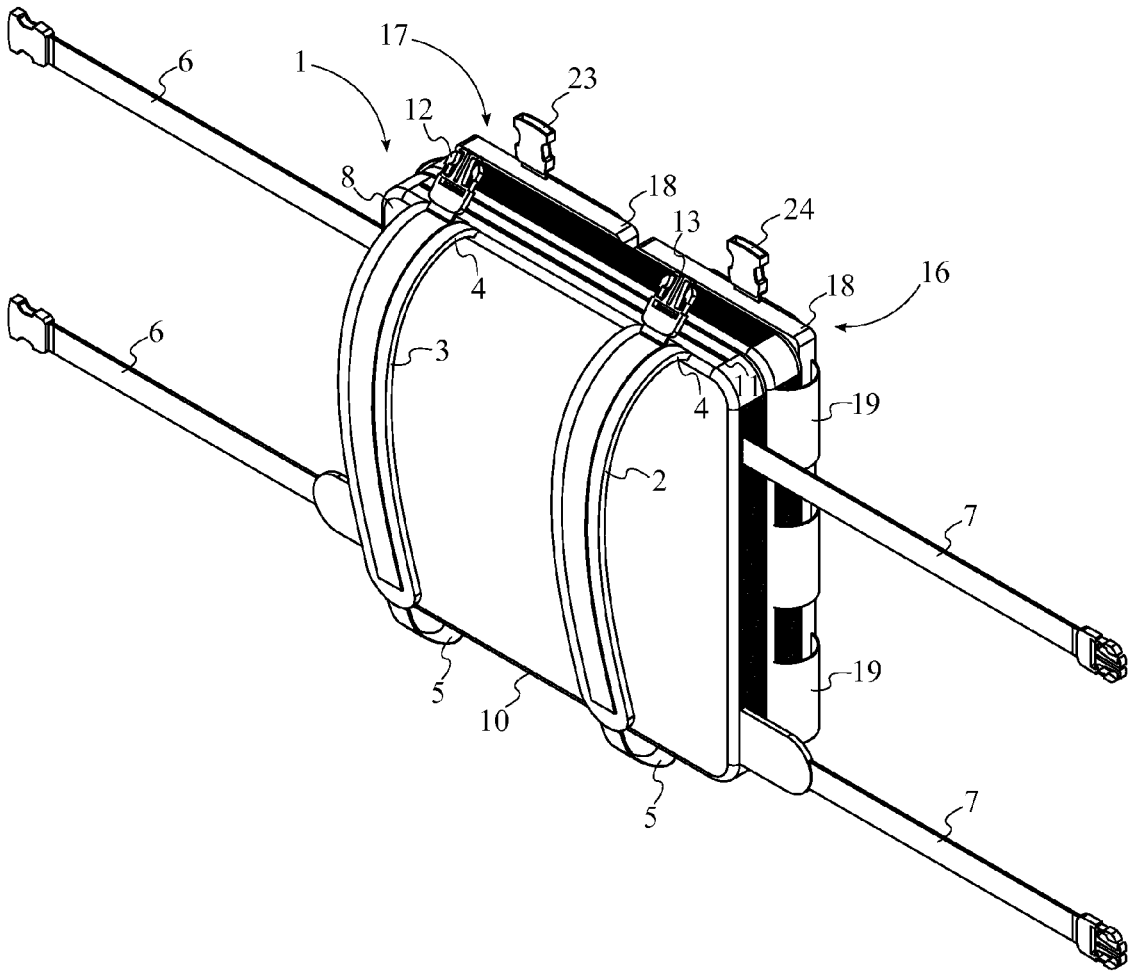
FIG. 1 is a perspective view of the present invention in the compact configuration.
Figure 3:
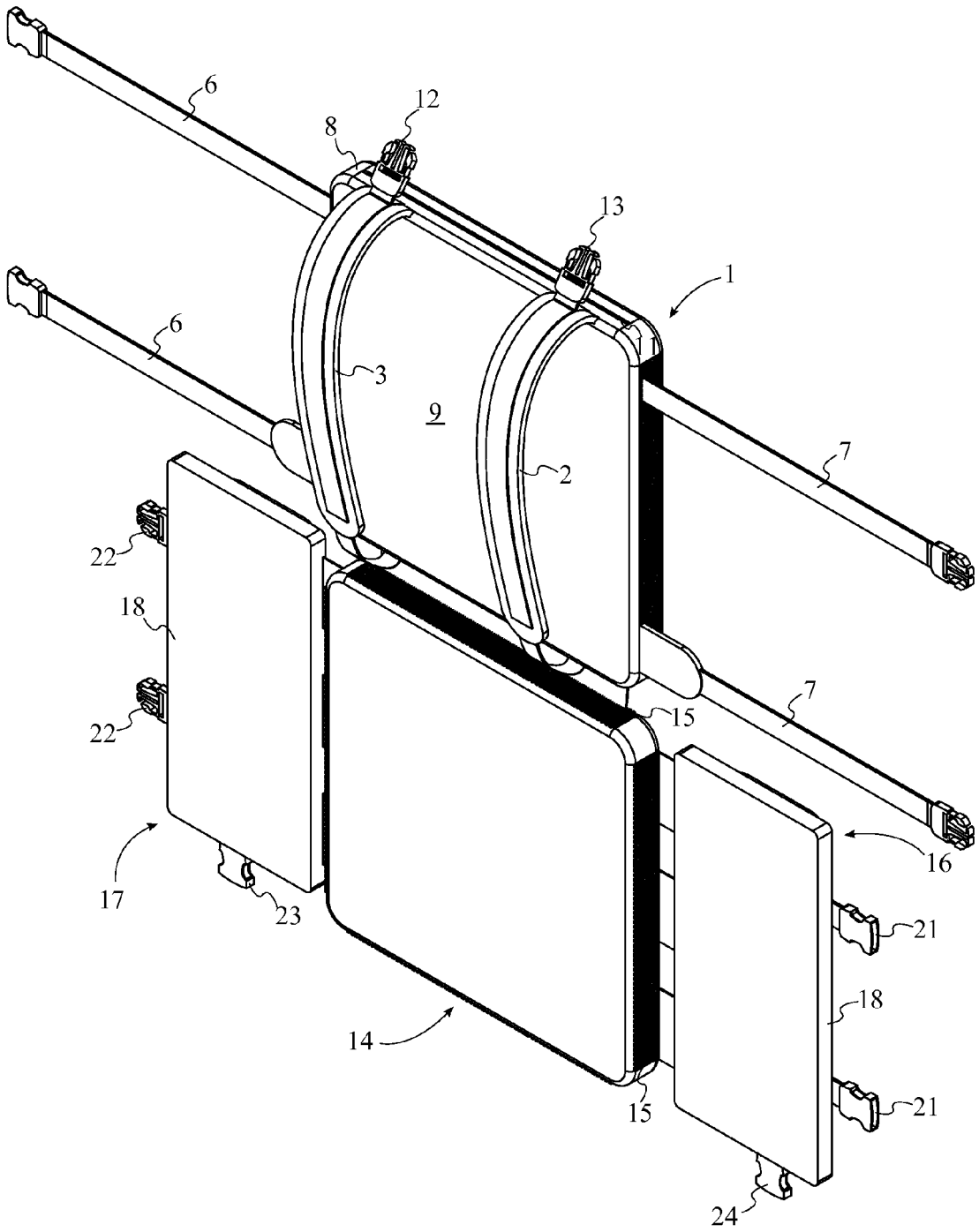
FIG. 3 is a perspective view of the unfolded present invention.

Referring to FIG. 1 and FIG. 3, the backpack 1 comprises a left shoulder strap 2, a right shoulder strap 3, a first plurality of tree-hugging straps 6, and a second plurality of tree-hugging straps 7. The left shoulder strap 2 and the right shoulder strap 3 allow the user to wear the article carrier around his or her shoulders for convenient transportation. The first plurality of tree-hugging straps 6 and the second plurality of tree-hugging straps 7 are positioned opposite of each other across the backpack 1 and allow the user to mount the backpack 1 to a structure or object such as a tree. Additionally, the first plurality of tree-hugging straps 6 and the second plurality of tree-hugging straps 7 are positioned perpendicular to the left shoulder strap 2 and the right shoulder strap 3. The first plurality of tree-hugging straps 6 and the second plurality of tree-hugging straps 7 may be wrapped around the tree and tied together in order to secure the backpack 1 in place on the tree. Two of the first plurality of tree-hugging straps 6 and the second plurality of tree-hugging straps 7 may be wrapped around the user's waist as needed. The first plurality of tree-hugging straps 6 and the second plurality of tree-hugging straps 7 may be secured to one another by means including, but not limited to, clips and buckles. The first plurality of tree-hugging straps 6 and the second plurality of tree-hugging straps 7 may additionally be attached to the backpack 1 via gussets.

Figure 4:
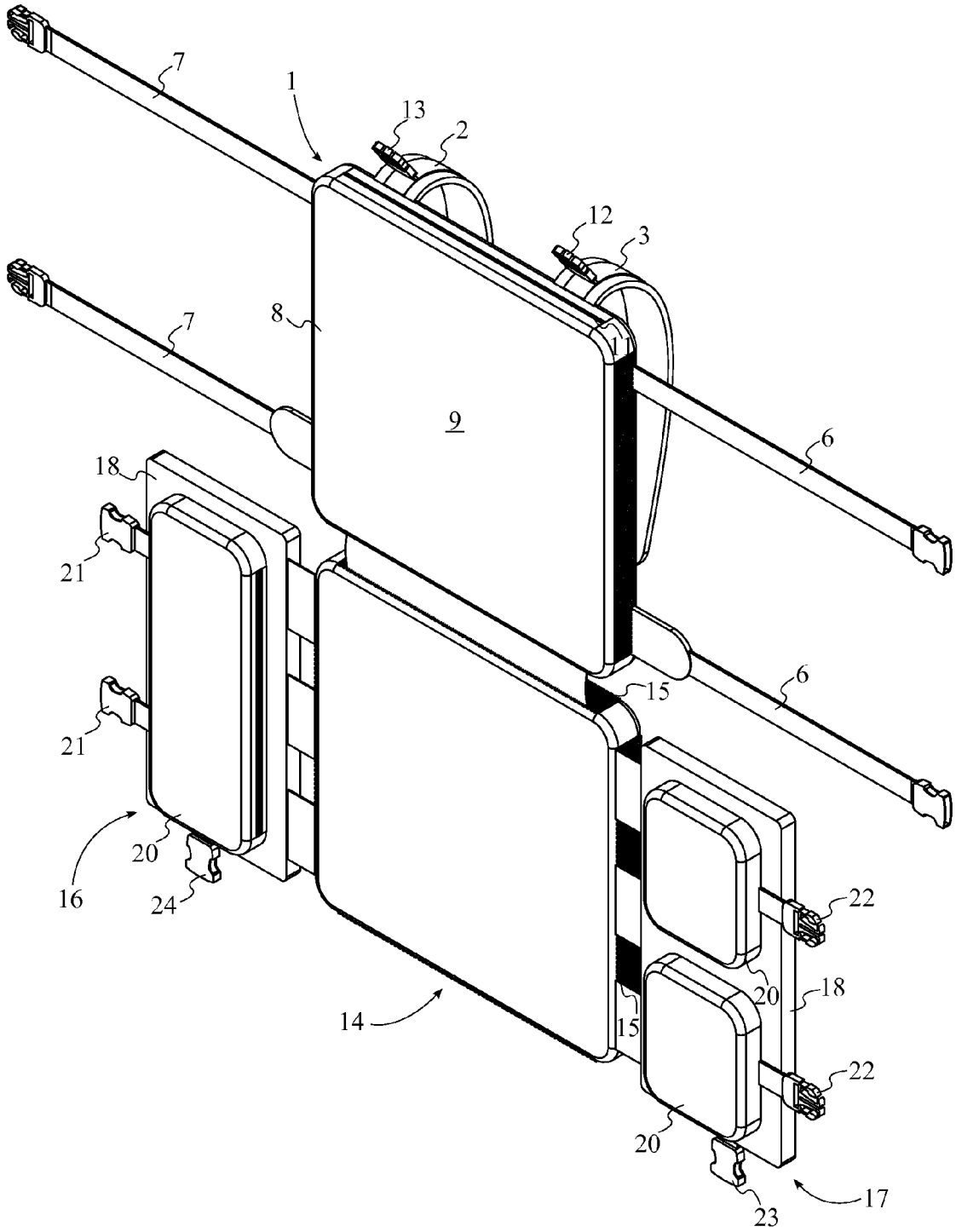
FIG. 4 is an alternative perspective view of the unfolded present invention.

The seat 14 comprises a plurality of load-bearing mounts 15 with the load-bearing mounts laterally connected around the seat 14 as shown in FIG. 3. The seat 14 is foldably and adjacently attached to the backpack 1, allowing the article carrier to be folded into a compact configuration or unfolded into a deployed configuration. The left wing 16 and the right wing 17 are positioned opposite of each other across the seat 14 as shown in FIG. 3 and FIG. 4. The backpack 1 is positioned in between the left wing 16 and the right wing 17. The left wing 16 and the right wing 17 are detachably and hingedly attached to the plurality of load-bearing mounts 15. This allows the left wing 16 and the right wing 17 to be oriented into a compact configuration or a deployed configuration as well. Additionally, the left wing 16 and the right wing 17 may detached and replaced on the plurality of load-bearing mounts 15.

Referring to FIG. 3 and FIG. 4, the present invention further comprises a first backpack clip 12, a second backpack clip 13, a first wing buckle 23, and a second wing buckle 24. The first backpack clip 12 and the second backpack clip 13 are connected adjacent to the backpack 1 opposite of the seat 14. Additionally, the first backpack clip 12 and the second backpack clip 13 are offset from each other. This offset positioning places the first backpack clip 12 and the second backpack clip 13 into an aligned position with the first wing buckle 23 and the second wing buckle 24. The first wing buckle 23 is connected adjacent to the left wing 16 opposite of the backpack 1 while the second wing buckle 24 is connected adjacent to the right wing 17 opposite of the backpack 1. The first backpack clip 12, the second backpack clip 13, the first wing buckle 23, and the second wing buckle 24 are utilized to attach the left wing 16 and the right wing 17 to the backpack 1 when the article carrier is in a compact configuration. As such, the first backpack clip 12 is detachably engaged to the first wing buckle 23 and the second backpack clip 13 is detachably engaged to the second wing buckle 24. The first backpack clip 12 and the second backpack clip 13 may be released from the first wing buckle 23 and the second wing buckle 24 in order to separate the left wing 16 and the right wing 17 from the backpack 1 and bring the article carrier into a deployed configuration.

Figure 5:
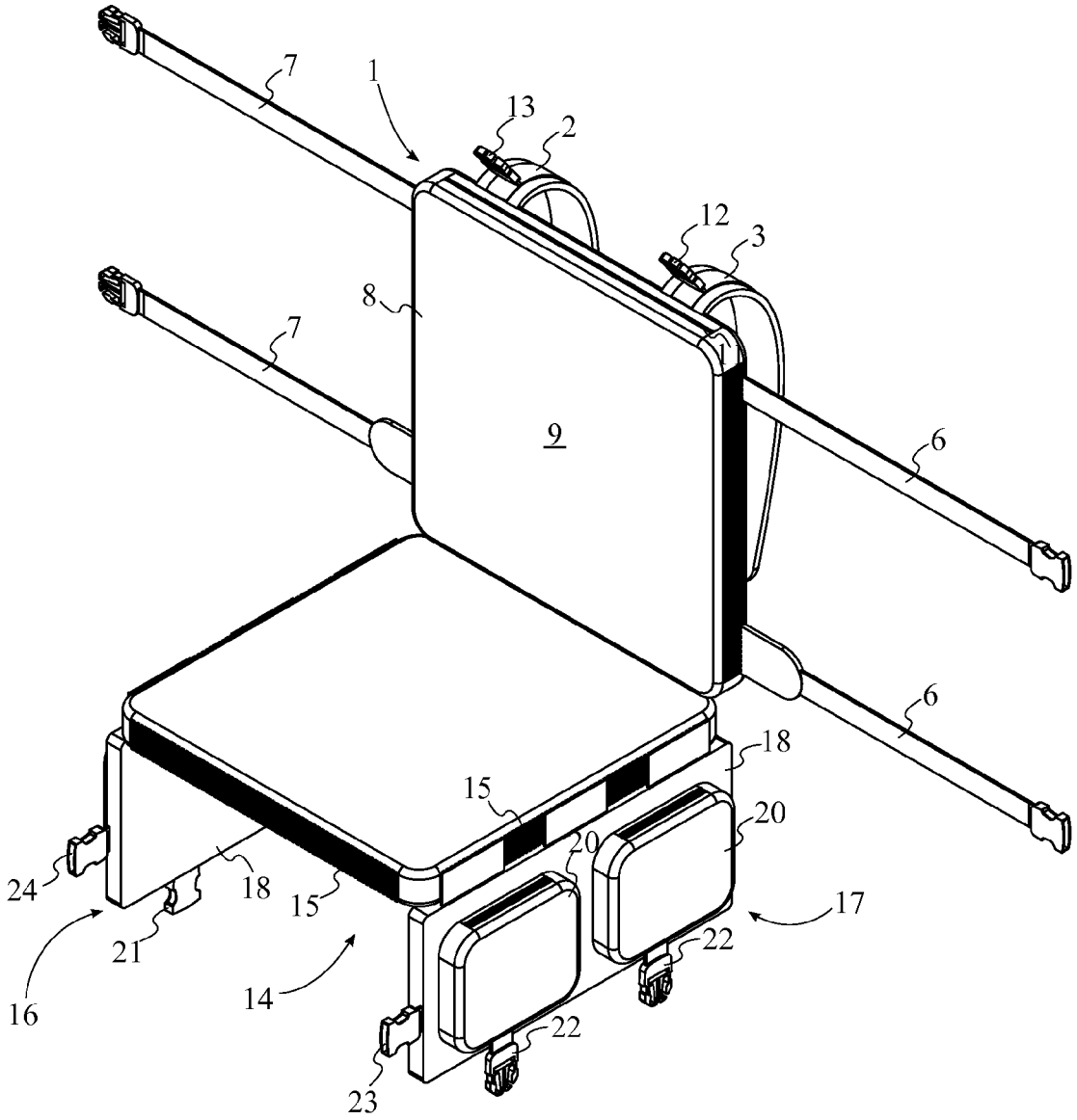
FIG. 5 is a perspective view of the present invention in the deployed configuration.

With reference to FIGS. 3-5, the left wing 16 and the right wing 17 each comprise a wing body 18, a plurality of load-bearing fasteners 19, and at least one panel compartment 20. The left wing 16 and the right wing 17 provide additional storage capacity and organization for equipment and personal items. The plurality of load-bearing fasteners 19 is laterally and foldably connected to the wing body 18 and is utilized to attach the left wing 16 and the right wing 17 to the seat 14. The lateral connection between the plurality of load-bearing fasteners 19 and the wing body 18 allows the left wing 16 and the right wing 17 to fold about the seat 14 when the left wing 16 and the right wing 17 are attached to the seat 14. As such, the plurality of load-bearing fasteners 19 is positioned adjacent to the seat 14 and is detachably attached to the plurality of load-bearing mounts 15. As such, the left wing 16 and the right wing 17 may be removed and repositioned as needed for improved organizational capabilities. The at least one panel compartment 20 is mounted onto the wing body 18 and is utilized to transport, protect, and organize equipment and personal items. The at least one panel compartment 20 comprises a means of closing and opening the at least one panel compartment 20. The means of opening and closing the at least one panel compartment 20 may include, but is not limited to, a zipper or a hook and loop fastener mechanism. Various example embodiments of the present invention may include multiple differing configurations of the at least one panel compartment 20 for both the left wing 16 and the right wing 17. Additionally, the left wing 16 and the right wing 17 may be moved to attach in additional configurations and arrangements in order to optimize organization.

Referring to FIG. 3 and FIG. 4, the present invention further comprises at least one securing buckle 21 and at least one securing clip 22. The at least one securing buckle 21 is foldably and adjacently connected to the left wing 16 opposite of the seat 14. Similarly, the at least one securing clip 22 is foldably and adjacently connected to the right wing 17 opposite of the seat 14. The at least one securing buckle 21 and the at least one securing clip 22 are utilized to secure the left wing 16 to the right wing 17 when the article carrier is in a compact configuration. As such, the at least one securing buckle 21 is detachably engaged by the at least one securing clip 22. The at least one securing clip 22 may be released from the at least one securing buckle 21 in order to separate the left wing 16 from the right wing 17.

With reference to FIG. 1 and FIG. 3, the backpack 1 further comprises a backpack body 8, a backrest 9, a backpack base 10, and a backpack opening 11. The backpack base 10 and the backpack opening 11 are positioned opposite to each other through the backpack body 8. The user may place equipment and personal items into the backpack 1 through the backpack opening 11. The backpack opening 11 features a means of opening and closing the backpack 1 such as, but not limited to, a zipper. The left shoulder strap 2 and the right shoulder strap 3 are offset from each other. Additionally, both the left shoulder strap 2 and the right shoulder strap 3 are positioned opposite to the backrest 9 through the backpack body 8. The backrest 9 is positioned adjacent to the seat 14 and is cushioned/padded for user comfort.

The first backpack clip 12 is mounted onto the left shoulder strap 2 adjacent to the backpack opening 11. The second backpack clip 13 is mounted to the right shoulder strap 3 adjacent to the backpack opening 11. As such, when the first backpack clip 12 is detachably engaged to the first wing buckle 23 and the second backpack clip 13 is detachably engaged to the second wing buckle 24, the left shoulder strap 2 and the right shoulder strap 3 are able to become load-bearing to the left wing 16 and the right wing 17. This provides a greater level of load-bearing support for the user when transporting the present invention.

The left shoulder strap 2 and the right shoulder strap 3 each comprise a first end 4 and a second end 5. The first end 4 of the left shoulder strap 2 is connected adjacent to the backpack opening 11. The second end 5 of the left shoulder strap 2 is connected adjacent to the backpack base 10. Similarly, the first end 4 of the right shoulder strap 3 is connected adjacent to the backpack opening 11 while the second end 5 of the right shoulder strap 3 is connected adjacent to the backpack base 10.

Figure 2:
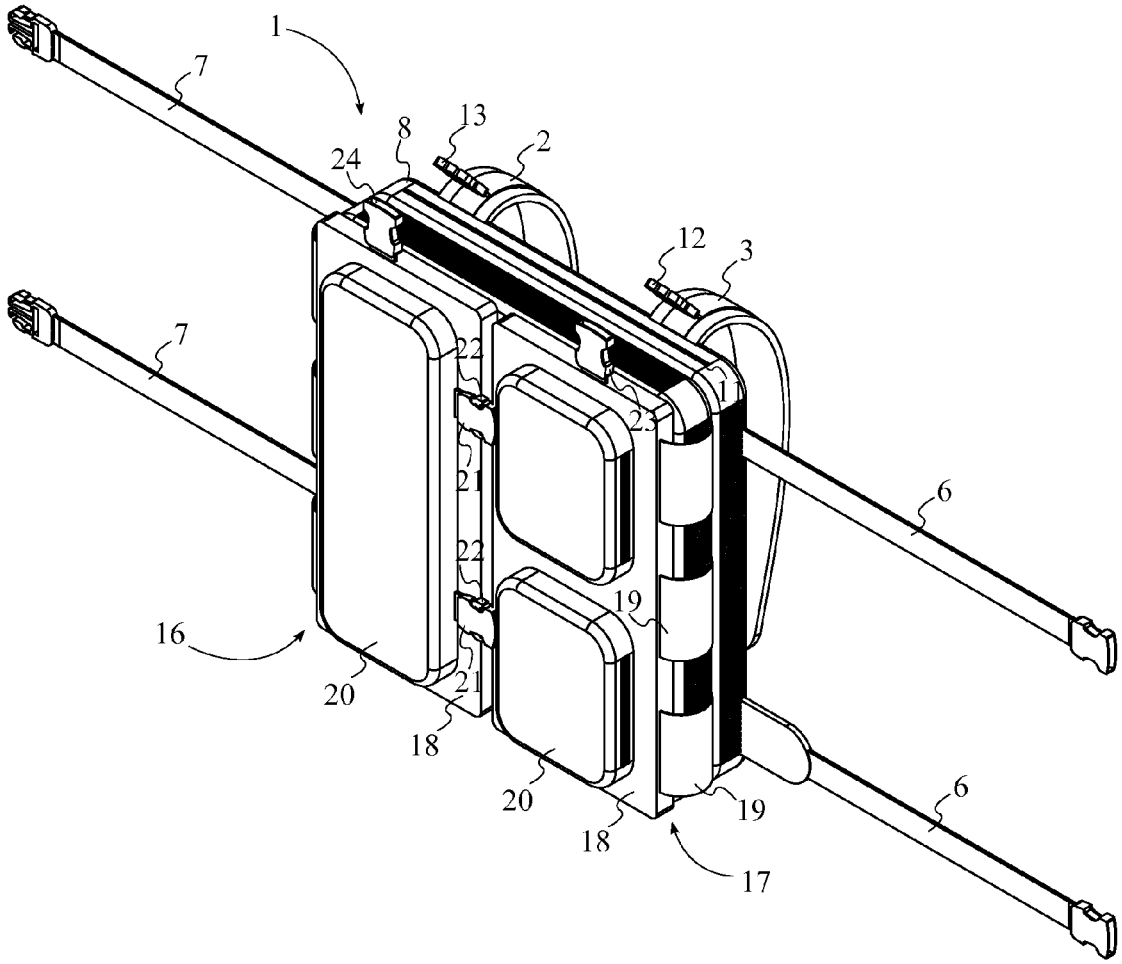
FIG. 2 is an alternative perspective view of the present invention in the compact configuration.

The article carrier may be utilized in two primary configurations including a compact configuration and a deployed configuration. In the compact configuration, the backrest 9 of the backpack 1, the seat 14, the left wing 16, and the right wing 17 are positioned and oriented for compactness of the article carrier. The compact configuration of the present invention is shown in FIG. 1 and FIG. 2. In the compact configuration, the seat 14 is positioned parallel and adjacent to the backrest 9. The left wing 16 and the right wing 17 are positioned adjacent to each other. Additionally, the left wing 16 and the right wing 17 are positioned adjacent and parallel to the seat 14 opposite of the backrest 9. The left wing 16 and right wing 17 are joined to the backpack 1 by detachably engaging the first backpack clip 12 to the first wing buckle 23 and detachably engaging the second backpack clip 13 to the second wing buckle 24.

In the deployed configuration, the backrest 9 of the backpack 1, the seat 14, the left wing 16, and the right wing 17 are positioned and oriented for providing seating support for the user as well as providing convenient access to items within the left wing 16 and the right wing 17. The deployed configuration of the present invention is shown in FIG. 5. The deployed configuration relates generally to mounting the backpack 1 to a structure or object such as a tree. The seat 14 is positioned perpendicular to the backrest 9, allowing the user to be seated on the seat 14 with his or her back oriented parallel to the backrest 9. The left wing 16 and the right wing 17 are positioned opposite to each other across the seat 14. The left wing 16 and the right wing 17 are positioned perpendicular to the seat 14 and perpendicular to the backrest 9. The perpendicular orientation of the left wing 16 and the right wing 17 place the left wing 16, the right wing 17, and any items within the at least one panel compartment 20 of the left wing 16 or the right wing 17 into a position of easy access. Because the left wing 16 and the right 17 are detachable, the user may install the left wing 16 and the right wing 17 in a variety of positions and arrangements as needed for improved organizational capabilities.

The object of the present invention is to facilitate transportation and organization of equipment and personal items as well as provide protection for the equipment and personal items. The present invention additionally provides the user with a cushioned/padded seating option. In the deployed configuration, the present invention may additionally be utilized in conjunction with existing outdoor equipment such as, but not limited to, a tree stand. The first plurality of tree-hugging straps 6 and the second plurality of tree-hugging straps 7 may be wrapped around a tree or similar object in order to secure the present invention to the object. The seat 14 may be supported by existing outdoor equipment as well in order to provide a cushioned/padded seating surface. In the deployed configuration, the left wing 16 and the right wing 17 are oriented in a manner such that the left wing 16, the right wing 17, and any contents within both are easily accessible. When the present invention is not in use or when compactness is desired, the present invention may be placed into the compact configuration.

Although the invention has been explained in relation to its preferred embodiment, it is to be understood that many other possible modifications and variations can be made without departing from the spirit and scope of the invention as hereinafter claimed.

What is claimed is:

1. An article carrier comprises:
a backpack;
a seat;
a left wing;
a right wing;
the backpack comprises a left shoulder strap, a right shoulder strap, a plurality of tree-hugging straps;
the seat comprises a plurality of load-bearing mounts;
the load-bearing mounts being laterally connected around the seat;
the seat being foldably and adjacently attached to the backpack;
the left wing and the right wing being positioned opposite of each other across the seat;
the backpack being positioned in between the left wing and the right wing;
the left wing and the right wing being detachably and hingedly attached to the plurality of load-bearing mounts;
a first fastener and a second fastener being connected adjacent to the backpack opposite of the seat;
the first fastener and the second fastener being offset from each other;
a third fastener being connected adjacent to the left wing opposite of the backpack;
a fourth fastener being connected adjacent to the right wing opposite of the backpack;
the first fastener being detachably engaged to the third fastener; and
the second fastener being detachably engaged to the fourth fastener.

2. The article carrier as claimed in claim 1 further comprises:
the left wing and the right wing each comprise a wing body, a plurality of load-bearing fasteners, and at least one panel compartment;
the plurality of load-bearing fasteners being laterally and foldably connected to the wing body;
the plurality of load-bearing fasteners being positioned adjacent to the seat;
the plurality of load-bearing fasteners being detachably attached to the plurality of load-bearing mounts; and
the at least one panel compartment being mounted onto the wing body.

3. The article carrier as claimed in claim 1 further comprises:
at least one securing buckle;
at least one securing clip;
the at least one securing buckle being foldably and adjacently connected to the left wing opposite of the seat;
the at least one securing clip being foldably and adjacently connected to the right wing opposite of the seat; and
the at least one securing buckle being detachably engaged by the at least one securing clip.

4. The article carrier as claimed in claim 1 further comprises:
the backpack further comprises a backpack body, a backrest, a backpack base, and a backpack opening;
the backpack base and the backpack opening being positioned opposite to each other through the backpack body;
the left shoulder strap and the right shoulder strap being offset from each other;
both the left shoulder strap and the right shoulder strap being positioned opposite to the backrest through the backpack body; and
the backrest being positioned adjacent to the seat.

5. The article carrier as claimed in claim 4 further comprises:
the first fastener being mounted onto the left shoulder strap adjacent to the backpack opening; and
the second fastener being mounted onto the right shoulder strap adjacent to the backpack opening.

6. The article carrier as claimed in claim 4 further comprises:
the left shoulder strap and the right shoulder strap each comprise a first end and a second end;
the first end of the left shoulder strap being connected adjacent to the backpack opening;
the second end of the left shoulder strap being connected adjacent to the backpack base;
the first end of the right shoulder strap being connected adjacent to the backpack opening; and
the second end of the right shoulder strap being connected adjacent to the backpack base.

7. The article carrier as claimed in claim 1 further comprises:
wherein a backrest of the backpack, the seat, the left wing, and the right wing are in a compact configuration;
the seat being positioned parallel and adjacent to the backrest;
the left wing and the right wing being positioned adjacent to each other; and
both the left wing and the right wing being positioned adjacent and parallel to the seat opposite of the backrest.

8. The article carrier as claimed in claim 1 further comprises:
wherein a backrest of the backpack, the seat, the left wing, and the right wing are in a deployed configuration;
the seat being positioned perpendicular to the backrest;
the left wing and the right wing being positioned opposite to each other across the seat;

the left wing and the right wing being positioned perpendicular to the seat; and the left wing and the right wing being positioned perpendicular to the backrest.

9. An article carrier comprises:

a backpack;

a seat;

a left wing;

a right wing;

the backpack comprises a left shoulder strap, a right shoulder strap, a plurality of tree-hugging straps;

the seat comprises a plurality of load-bearing mounts;

the load-bearing mounts being laterally connected around at least three sides of the seat;

the seat being foldably and adjacently attached to the backpack; and the left wing and the right wing being detachably and hingedly attached to the plurality of load-bearing mounts.

10. The article carrier as claimed in claim 9 further comprises:

a first fastener;

a second fastener;

a third fastener;

a fourth fastener;

the first fastener and the second fastener being connected adjacent to the backpack opposite of the seat;

the first fastener and the second fastener being offset from each other;

the third fastener being connected adjacent to the left wing opposite of the backpack;

the fourth fastener being connected adjacent to the right wing opposite of the backpack;

the first fastener being detachably engaged to the third fastener; and the second fastener being detachably engaged to the fourth fastener.

11. The article carrier as claimed in claim 9 further comprises:

at least one securing buckle;

at least one securing clip;

the at least one securing buckle being foldably and adjacently connected to the left wing opposite of the seat;

the at least one securing clip being foldably and adjacently connected to the right wing opposite of the seat; and the at least one securing buckle being detachably engaged by the at least one securing clip.

12. The article carrier as claimed in claim 9 further comprises:

the backpack further comprises a backpack body, a backrest, a backpack base, and a backpack opening;

the backpack base and the backpack opening being positioned opposite to each other through the backpack body;

the left shoulder strap and the right shoulder strap being offset from each other;

both the left shoulder strap and the right shoulder strap being positioned opposite to the backrest through the backpack body; and the backrest being positioned adjacent to the seat.

13. The article carrier as claimed in claim 12 further comprises:

a first fastener;

a second fastener;

the first fastener being mounted onto the left shoulder strap adjacent to the backpack opening; and the second fastener being mounted onto the right shoulder strap adjacent to the backpack opening.

14. The article carrier as claimed in claim 12 further comprises:

the left shoulder strap and the right shoulder strap each comprise a first end and a second end;

the first end of the left shoulder strap being connected adjacent to the backpack opening;

the second end of the left shoulder strap being connected adjacent to the backpack base;

the first end of the right shoulder strap being connected adjacent to the backpack opening; and the second end of the right shoulder strap being connected adjacent to the backpack base.

15. The article carrier as claimed in claim 9 further comprises:

wherein a backrest of the backpack, the seat, the left wing, and the right wing are in a compact configuration;

the seat being positioned parallel and adjacent to the backrest;

the left wing and the right wing being positioned adjacent to each other; and both the left wing and the right wing being positioned adjacent and parallel to the seat opposite of the backrest.

16. The article carrier as claimed in claim 9 further comprises:

wherein a backrest of the backpack, the seat, the left wing, and the right wing are in a deployed configuration;

the seat being positioned perpendicular to the backrest; and the left wing or the right wing being positioned opposite the backrest, perpendicular to the seat and parallel to the backrest.

17. An article carrier comprises:

a backpack;

a seat;

a left wing;

a right wing;

the backpack comprises a left shoulder strap, a right shoulder strap, a plurality of tree-hugging straps;

the seat comprises a plurality of load-bearing mounts;

the load-bearing mounts being laterally connected around the seat around at least three sides of the seat;

the seat being foldably and adjacently attached to the backpack;

the left wing and the right wing being detachably and hingedly attached to the plurality of load-bearing mounts;

a first fastener and a second fastener being connected adjacent to the backpack opposite of the seat;

the first fastener and the second fastener being offset from each other;

a third fastener being connected adjacent to the left wing opposite of the backpack;

a fourth fastener being connected adjacent to the right wing opposite of the backpack;

the first fastener being detachably engaged to the third fastener; and the second fastener being detachably engaged to the fourth fastener.

* * * * *